United States Patent [19]

Mullen

[11] Patent Number: 4,610,860

[45] Date of Patent: Sep. 9, 1986

[54] METHOD AND SYSTEM FOR PRODUCING CARBON FIBERS

[75] Inventor: Charles K. Mullen, Anaheim Hills, Calif.

[73] Assignee: Hitco, Newport Beach, Calif.

[21] Appl. No.: 742,103

[22] Filed: Jun. 5, 1985

Related U.S. Application Data

[63] Continuation of Ser. No. 541,652, Oct. 13, 1983, abandoned.

[51] Int. Cl.[4] ..... D01F 9/22

[52] U.S. Cl. ..... 423/447.8; 423/447.4; 423/447.6; 423/447.1; 264/29.2; 264/29.7

[58] Field of Search ..... 423/447.1, 447.2, 447.4, 423/447.7, 447.8; 264/29.2, 29.6, 29.7

[56] References Cited

U.S. PATENT DOCUMENTS

| | | | |
|---|---|---|---|
| 4,073,870 | 2/1978 | Saji et al. | 423/447.7 |
| 4,100,004 | 7/1978 | Moss et al. | 423/447.8 |
| 4,301,136 | 11/1981 | Yamamoto et al. | 423/447.8 |

FOREIGN PATENT DOCUMENTS

| | | | |
|---|---|---|---|
| 47-26969 | 7/1972 | Japan | 423/447.7 |
| 49-30628 | 3/1974 | Japan | 423/447.1 |
| 50-69320 | 6/1975 | Japan | 264/29.2 |
| 1093084 | 11/1967 | United Kingdom | 423/447.2 |
| 1284399 | 8/1972 | United Kingdom | 423/447.7 |

*Primary Examiner*—William R. Dixon, Jr.
*Assistant Examiner*—Steven Capella
*Attorney, Agent, or Firm*—Fraser and Bogucki

[57] ABSTRACT

High tensile carbon fibers are provided with a high yield process in which, after oxidation of a precursor, the fibers are first precarbonized in an inert atmosphere to to about 600° C. while imparting 5–10% stretch. In precarbonizing, the fibers are initially heated in a sweeping manner with substantial volumes of hot inert gas which is extracted along with products of decomposition before the fibers are cooled to a low, non-reactive exit temperature. The arrangement minimizes redeposition of tars on the fibers and stretches the fibers in a range in which substantial off-gassing occurs. Thereafter the fibers are finally carbonized at a higher temperature with a different tension being applied, to provide a more reliable less sensitive process that enables oxidation to be effected more rapidly.

27 Claims, 6 Drawing Figures

METHOD AND SYSTEM FOR PRODUCING CARBON FIBERS

BACKGROUND OF THE INVENTION

The present invention relates to the production of carbon fibers from carbon-containing precursor fibers such as polyacrylonitrile fibers, and particularly to methods and systems for processing such precursor fibers to provide high tensile carbon fibers with improved yield and uniformity.

A variety of methods have been employed for producing carbon fibers by first oxygenating and then carbonizing precursor fibers, such as polyacrylonitrile fibers, in an inert atmosphere. Most methods keep the fibers under tension, as by restraint against shrinkage, during at least some of the process steps. Tension during oxidation, also called stabilization, is a precondition to obtaining the levels of tensile strength and modulus of elasticity that are desired in the final product. Many variants have been employed in the carbonization phase, which takes the oxidized fibers to a higher, final temperature level within a relatively short time, using a nitrogen or other inert gas as the environment. Carbonization has most often been carried out with single stage furnaces, but multiple stages have also been used. Elongation and restraint against shrinkage have been employed, generally in one stage. Although the material used is sometimes in fabric form, the typical process utilizes large tows, with multiple filaments being distributed across a flat plane so that longitudinal tension can be exerted and the gases have substantially equal access to the fibers.

Illustrative of variations in the above noted procedures for producing carbon fibers are U.S. Pat. Nos. 3,652,22 3,663,173 and 3,716,331, which deal with the use of multiple carbonization stages and the use of tension during carbonization, but all are concerned with partially carbonized cellulosic precursors. Restraint against shrinkage is used with polyacrylonitrile fibers during carbonization in U.S. Pat. Nos. 3,698,865 and 3,412,062. In U.S. Pat. No. 4,100,004 a two stage oxygenation procedure is disclosed together with a two stage carbonizing procedure, employing temperatures in the range of 600° to 700° C. in the first carbonizing furnace and a temperature in the range of 1050° to 1600° C. in the second furnace.

A Japanese publication No. J5-4147-222 discloses a process for producing carbon fiber with improved tensile strength and modulus by first passing acrylic fibers through an oxidizing oven at 230°–250° C. to effect 10% shrinkage. The flameproofed or stabilized fibers are then preliminarily carbonized at a temperature from 300° to 800° C., particularly from 400° to 600° C. while being subjected to a high stretch up to 25%, in a nitrogen gas atmosphere. The elongated partially carbonized fibers thus obtained are finally or completely carbonized at elevated temperature of 1300° C. with 3% shrinkage. This is a specific example of the multiple stage carbonization techniques mentioned above. The use of multiple stages slows the outgassing or decomposition process somewhat, reducing defects in the carbon fibers.

More recently in the development of this art, workers have confronted the secondary but important problems arising from the release of volatile components and tars in the carbonization environment. It has been recognized that redeposited tars and other matter accumulate and restrict the flow of gases, and further that contact of this matter with the fibers damages or weakens them. Yields are not only decreased but the entire process is unduly sensitive to operating conditions. Consequently, as shown by various publications, different expedients have been proposed for alleviation of problems arising from the products of decomposition. Examples of these approaches are found in U.S. Pat. No. 3,508,871 (using a solvent to remove tarry materials), Japan Kokai No. 7740622 (two stage carbonization), German Offen. No. 2133887 (fast carbonization using electric oven and volatiles removal), U.S. Pat. No. 4,020,273 (upward flow of gas in opposition to downward flow of fibers) and U.S. Pat. No. 4,073,870 (countercurrent flow of gas in a two section furnace).

SUMMARY OF THE INVENTION

In accordance with the invention, applicant has ascertained that interrelationships exist between the dynamic, chemical and dynamic processes occurring during carbonization and that a precarbonization procedure under controlled conditions is to be integrated with a final, higher temperature carbonization step. In precarbonization, substantial gas evolution and rapid mechanical change are countered by both sweeping the fibers with preheated inert gas in a selected volume ratio and applying a significant percentage of stretch. The temperature profile in the precarbonization volume, and the residence time of the fibers therein, are chosen to be within controlled limits, with both entry and exit regions being at relatively low temperatures. Volumes of hot inert gas passing across the fibers in at least one specific region carry off decomposition products, such as volatiles and tars generated during precarbonization, to exhaust outlets which are spaced and disposed such that redeposition on the fibers does not occur. The precarbonization step is thus carried out while maintaining products of decomposition above a redeposition temperature until they are out of communication with the fibers. A predetermined amount of heat gas volume per unit weight of fiber provides uniform rapid heating and entrainment of 90% or more of the tars and volatiles. The subsequent carbonization is effected using some tension, but substantially less than during precarbonization.

It has been found particularly that carrying out the precarbonization of the oxidized and stabilized carbon fibers at temperatures ranging from about 350° to 620° C., while passing inert gas such as nitrogen preheated to a temperature of at least about 400° C., preferably ranging from about 400° to about 450° C. at a rate of about 10 to 17 liters of gas per gram of carbon fibers, across the fibers, and while concurrently stretching the fibers from 5% to 20% in comparison to the length of the stabilized fibers, and by thereafter carbonizing the previously heated stabilized fibers at a temperature ranging from about 1100° to about 1250° C., while limiting shrinkage (negative stretch) to the range of −2.5% to −5.0%, results in removal of in excess of 90% of the tars during precarbonization, avoids redeposition of such tars on the fibers, and produces high tensile carbon fibers, at efficient rates. Further this procedure enables an increase in the speed of passage of the fibers through the earlier oxidizing zone as well as through both the precarbonizing and carbonizing zones.

Methods in accordance with the invention for producing carbon fibers having high tensile strength from precursor fibers comprise the steps of:

(a) heating the fibers under oxidizing conditions at a temperature ranging from about 200° to about 300° C. while elongating the fibers in a range of 10%–20% relative to their original length to provide stabilized fibers;

(b) heating the stabilized fibers in the range of about 350° to about 620° C. while passing heated inert gas at a temperature of at least about 400° C. across continuously advancing fibers, the gas flow being at a rate of between about 10 and about 17 liters of gas per gram of fibers, the gas flows being directed tangential to the fibers but toward exhaust outlets intermediate the ends of the heating zone to thereby prevent deposition of tars on the fibers, while concurrently stretching the fibers from about 5% to about 20% in comparison to the length of the stabilized fibers, thereby partially carbonizing said fibers;

(c) establishing a temperature profile through the use of auxiliary heating that peaks in an intermediate region substantially coextensive with the exhaust outlets and is at low levels in the fiber entry and exit regions; and (d) thereafter carbonizing the previously heated stabilized and precarbonized fibers at a temperature in the range of about 800° to about 1250° C., while limiting shrinkage (negative stretch) to the range of about −2.5% to −5.0%.

The inventive concepts also include novel furnace arrangements in which fibers are precarbonized by passage as a distributed tow through a vertical furnace structure having a group of differentially driven tension rollers at each end. A gas afterburner-preheater combination burns products of decomposition from the carbonization furnace while preheating inert gas to a desired level for input to the precarbonizing furnace. The input hot gas flows are injected adjacent a lower region of the furnace, tangential to the plane of the fibers on opposite sides thereof. Exhaust flows are taken from each side of the furnace at regions in which the internal temperature is still well above redeposition temperature. It is advantageous to confine the tow of precarbonizing fibers within a muffle and to raise the fibers to peak temperature levels by electrical elements outside the muffle. End seal systems incorporating injection of cold inert gas and water cooled seals insure against inflow of oxygen and aid in maintaining the desired temperature profile in the furnace.

BRIEF DESCRIPTION OF THE DRAWINGS

A better understanding of the invention may be had by reference to the following description, taken in conjunction with the accompanying drawings, in which.

DETAILED DESCRIPTION OF THE INVENTION

Figure 1:
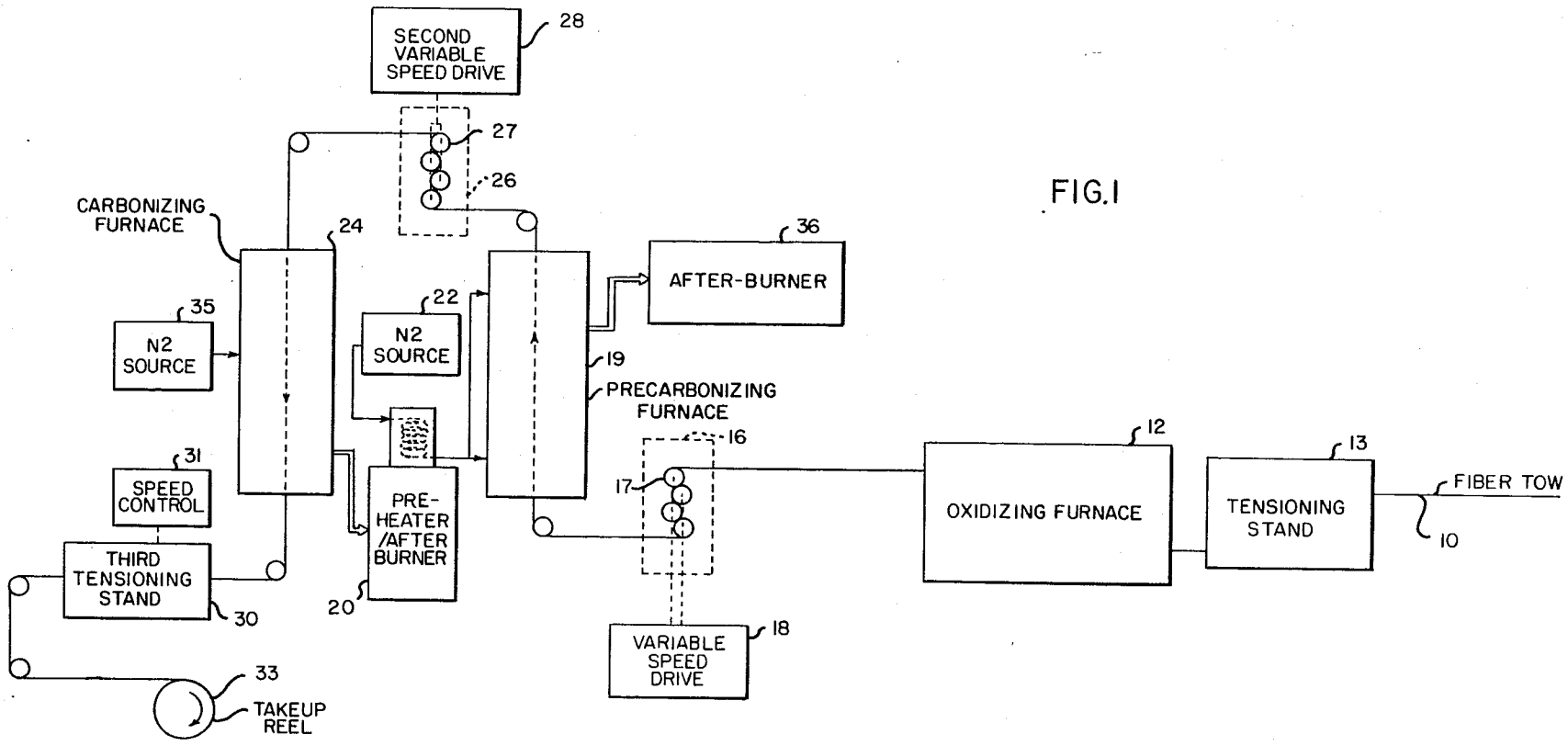
FIG. 1 is a flow sheet of one embodiment of a method of making carbon fibers according to the invention.

Precursor fibers for use in methods and systems in accordance with the invention can be any carbon-containing fiber which is suitable for carbonizing, including polyacrylonitrile and copolymers, such as, for example, copolymers of acrylonitrile and other compatible monomers, e.g. methyl methacrylate or vinyl acetate. The preferred fibers according to the present invention are polyacrylonitrile (PAN) fibers, although it should be noted that other fibers which are oxidized or stabilized, then carbonized with controlled tension, may be used to particular advantage.

In methods in accordance with the invention, the precursor, e.g. PAN, fibers are converted to carbon fibers by first passing the precursor fibers through an oxidation furnace or zone to effect complete internal chemical transformation to stabilized fibers, as well known in the art. The precursor fibers, which can be in the form of a multifilament sheet, tow or web, are heated in contact with an oxidizing medium such as oxygen, or oxygen-containing gases including air. Chemical oxidation processes are also known and may alternatively be used. The precursor fibers are heated in the oxidation furnace to a temperature ranging from 220° to 300° C., preferably about 240° to about 280° C., at which temperatures the cross-linking reaction essential to stabilization can be completed. During oxidation, the precursor fibers are heated gradually to the specific temperature range, and are maintained in the range for a relatively lengthy period, e.g. from about 40 to about 90 minutes. Concurrently, relatively high stretch of the fibers is used in order to preserve molecular orientation and crystalline microstructure in order to achieve suitable levels of tensile strength and modulus of elasticity in the finally processed fiber. Elongation or stretching of the fibers in an amount in the range of about 10% to 15% relative to their original length is usually employed. In the oxidation reaction, exothermic heat is carried away by circulation of substantial quantities of air within the furnace and about the entrained fibers, so as to properly dissipate the exothermic heat produced and prevent catastrophic failure. The oxidation furnace can be a single zone but is preferably in the form of multiple zones, up to four, of successively higher temperatures.

Line speeds of the fibers or fiber web through the oxidation furnace can vary but are typically in the range of 3.1 feet per minute. The oxidation densities can range from 1.33 to 1.42, for different line speeds. It has been found that line speeds of the fibers in the oxidation furnace can be increased because of the better performance due to the carbonizing procedure set forth in greater detail below. Such line speeds can apply to various fiber materials, webs and tows, although it is preferred to use a planar distribution of 3K (3000 ends), 6K, 10K or 12K tows (depending on the production rate desired).

The oxidized fibers exiting the oxidation furnace are then subjected to two different stages of carbonization, either immediately on a continuous flow basis or after a delay. The two separate stages employ different temperature levels, different heating conditions, different mechanical handling factors and different gas dynamics.

A first furnace or heating zone may be regarded as a precarbonizing zone or stage in which the tow or web of fibers is heated, while stretching, at a temperature ranging from about 350° to 620° C., preferably in the 400° to 600° C. range. The heating in the precarbonizing zone is initially effected by injecting substantial volumes of inert gases, preferably nitrogen, preheated to a temperature range well above the highest level used during oxidation. The gases enter from about 400° to about 450° C., e.g. about 400° to 420° C., and impinge on and along the fibers within the interior of the furnace to carry away volatile gases and tars as they are emitted from the heated fibers. Additional thermal energy is added by means of heating elements in the intermediate region of the precarbonizing furnace so as to increase the temperature to a higher maximum, e.g. the preferred maximum of 600° C. in the midregion of the precarbonizing zone. Positive pressure and insulated flow paths are maintained for the outgassed products from the fibers, to insure an oxygen-free atmosphere and prevent contact with and recondensation on cold surfaces. By sweeping the fibers with hot inert gas flows, and maintaining the residual gases at a relatively high temperature, the tars which are carried away by the inert gases do not fall back or redeposit on the fibers or collect around the colder inlet or exit regions of the precarbonizing zone.

It has been found that best results, in terms of a high tensile strength carbon fiber, are obtained by employing from 10 to 17, preferably about 13, liters of inert gas or nitrogen, per gram of carbon fiber in the precarbonizing zone. In this precarbonization step the fibers undergo increasing temperature rise from the relatively low temperature entry region to a maximum value and then return to a lower temperature at the exit region, giving a temperature profile in the shape of a rounded peak. Maximum offgassing and loss of weight occurs in this step, as contrasted to later heating to higher temperature, and the fibers undergo a pronounced change in physical and chemical character. To preserve molecular orientation through this precarbonization phase, heating of the fibers is carried out while concurrently stretching the fibers from 5% to 20% in comparison to the length of the oxidized fibers, preferably in the range of 6% to 8%. It has been found that if the dilution factor, i.e. the ratio of the number of liters of inert gas or nitrogen, per gram of carbon fiber is too low, damage due to tar deposition on the fibers occurs. The average ultimate tensile strength of the fibers deteriorates, despite maintenance of other conditions in correspondence to the degree of tar concentration on the fibers. It has been found that significant positive stretching is an important parameter, in conjunction with the above noted dilution factor for flow of heated nitrogen in the precarbonizing zone, for production of uniform carbon fibers having high ultimate tensile strength. Products given off during heating in this stage introduce a tendency to shrink, but the fibers are compliant and have a degree of plasticity that permits substantial stretching, with beneficial results in improving internal orientation and alignment. Thus stretching in this region can be regarded as being most effective at the peak temperature subregion, and as acting in a manner to impart rather than preserve physical properties.

Residence time of the fibers in the precarbonizing zone can range from about 5 to about 20 minutes, usually from about 5 to about 10 minutes. The exhaust from the precarbonization furnace consists of a major proportion of nitrogen and minor amounts of off-gases consisting of carbon monoxide, with trace amounts of acrylonitrile, cyanide and hydrocynaic acid gases. In an example of such exhaust from a precarbonization furnace, such gases consisted of 97.1% nitrogen and 2.9% total off-gassed products from the fibers.

The precarbonized and stabilized fibers, in the form of a sheet or a tow, are then subjected to a final carbonizing stage taking place at a temperature in excess of 800° C. up to a final temperature range of about 1100° to about 1600° C., depending upon the balance of tensile strength vs. modulus of elasticity that is desired. Final temperatures of up to about 1250° C. are used to improve the tensile strength of the fibers. In a preferred example of a carbonizing zone, the multi-filament sheet, tow or web of fibers is heated in a first stage to a temperature ranging from about 850° to about 900° C., then in a second stage up to about 1100° C. and in a final stage to a temperature in the range from about 1100° to about 1250° C., preferably about 1100° to about 1200° C., which provides the major portion of heat treatment in the carbonizing zone. Residence time in the carbonizing zone can range from about 5 to about 10 minutes.

In the final carbonizing zone the treated fibers are passed through the zone while limiting shrinkage (negative stretch) to the range of −2.5% to −5.0% by maintaining suitable tension on the fibers traversing the zone. This has direct relation to the stretch conditions used during precarbonization. Again, a significant shrinkage would take place during carbonization as the final non-carbonaceous compounds are driven off. However, the fibers in this phase are substantially stronger (increasingly so as temperature increases) and the tension required to stretch them would approach a breaking stress. Consequently, restraint against shrinkage to the stated percentages acts to preserve the orientation and alignment previously established.

Referring now to FIG. 1 of the drawings, a continuous processing system is depicted that serially processes precursor PAN tow 10 into high tensile carbon fibers. The system is shown only schematically in FIG. 1 because details that bear upon apparatus in accordance with the invention are shown more explicitly in FIGS. 2–4. The precursor tow 10 is distributed into a planar sheet and passed through an oxidizing oven 12 from an initial variable speed tensioning stand 13 at the entrance ends thereof. The oxidizing oven 12 may include multiple stages and a number of roller sets disposed in relation to the stages so as to impose different controllable stretches in the fibers passing therethrough, by using high wrap angles about the rollers and differential drive velocities. Numerous alternative designs of oxidizing ovens and tension control systems are well known to those skilled in the art, and thus these need not be described in detail. However, by maintaining the temperature in different zones of the oxidizing oven 12 in increasing ranges from 240° C. up to about 280° C., employing a residence time of 60 to 90 minutes and stretching the fibers from 10–15% net relative to their original lengths, complete oxidation and internal cross-linking are obtained and stabilized fibers are provided that are suitable for subsequent carbonization. The length of the oven (and the number of multiple passes used) provide an average fiber advance rate of about 3.1 feet per minute, which is matched in subsequent processing steps in a continuous system.

From the oxidizing oven 12 the fibers pass to another tensioning stand 16, comprising a vertical stand of rollers 17 through which the sheet of fibers is wound in serpentine fashion. This stand 16 may be regarded as the first stand of the carbonizing portion of the system. It is often convenient to separate the process, as by stabilizing the fibers first and then carbonizing after a substantial delay rather than in one continuous sequence. A variable speed drive 18 coupled to the rollers 17 feeds the fibers at a selected rate into the bottom of a vertical precarbonizing furnace 19, which receives preheated inert gas from an afterburner/preheater 20 coupled to receive cold inert gas from a nitrogen source 22 and off-gassed product from an adjacent carbonizing furnace 24. The fibers pass vertically through the precarbonizing furnace 19 to a second tensioning stand 26 comprising a stand of rollers 27 controlled by a second variable speed drive 28. From the second tensioning stand 26 the sheet of fibers moves downwardly through the vertical carbonizing furnace 24 to a third tensioning stand 30 operated by a speed control 31, after which the fibers are wound onto a takeup reel 33. Nitrogen gas is injected into the carbonizing furnace from a source 35, the needed high internal temperature being attained by electrically energized susceptor elements (not shown). Off-gassed products are diverted to the afterburner/-preheater 20, and an afterburner 36 is also used to receive and neutralize the off-gassed residues from the precarbonization furnace 19. Both afterburners 20, 36 receive air and fuel to insure complete combustion.

The tow 10 of oxidized and stabilized fibers is passed through the precarbonizing furnace 19 and carbonizing furnace 24 under the previously described conditions of temperature, gas flow and applied tension according to the features of the invention in order to produce carbon fibers, particularly from PAN precursor fibers, with improved physical properties, including high tensile strength, particularly by extracting volatile products and tars so that there is no redeposition on the fibers.

Figure 2:
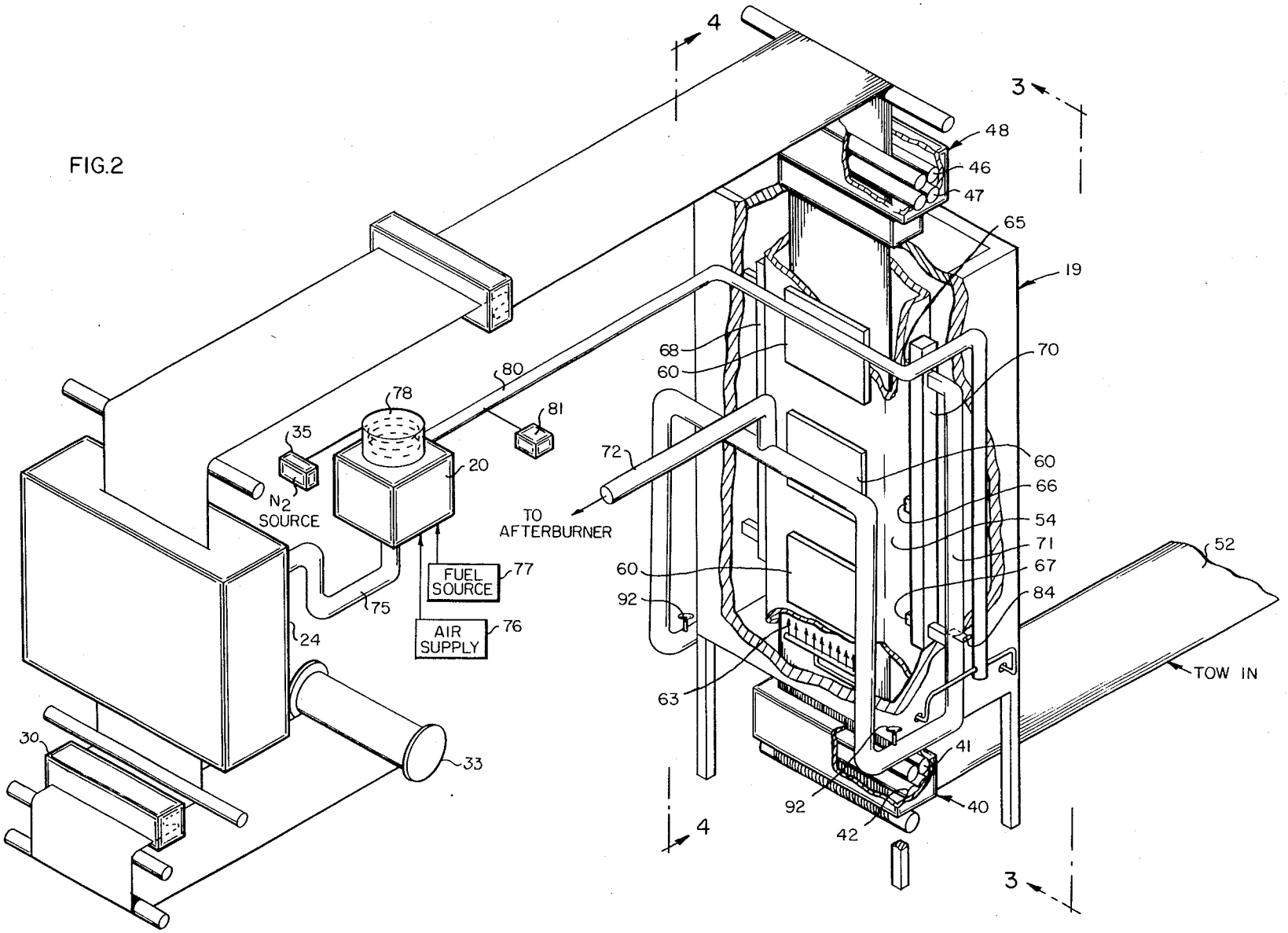
FIG. 2 is a simplified perspective view of a precarbonizing furnace and carbonizing furnace system in accordance with the invention process.
Figure 3:
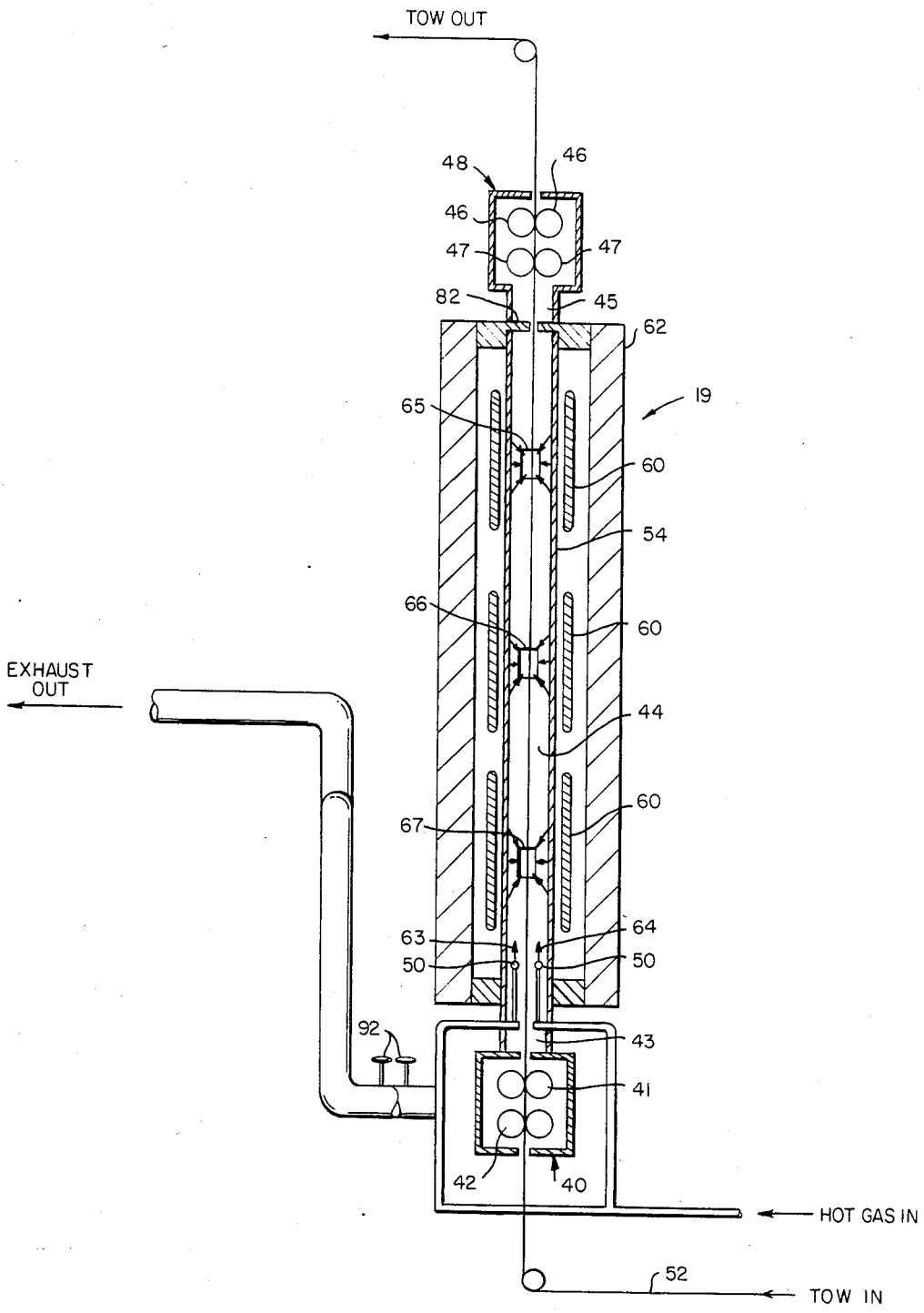
FIG. 3 is a side sectional view of the precarbonizing furnace.
Figure 4:
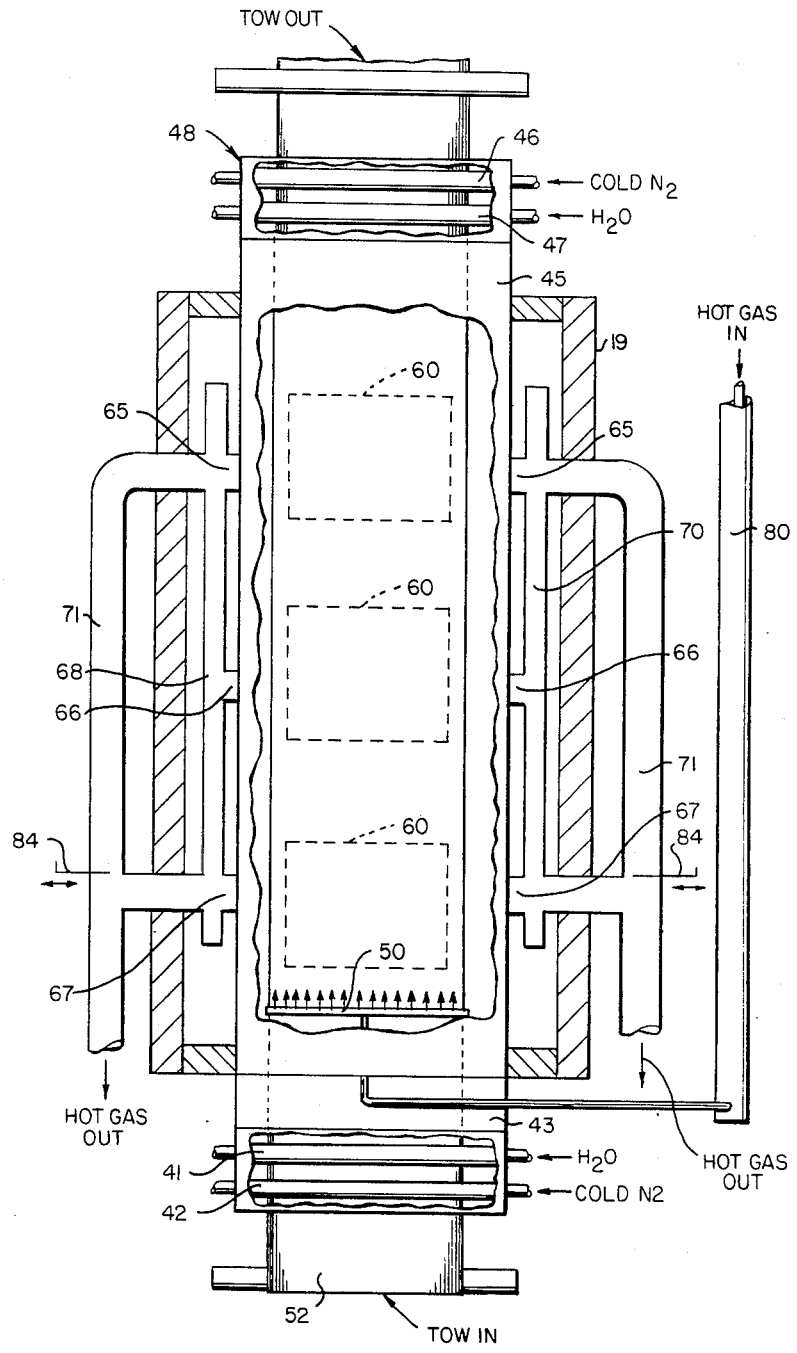
FIG. 4 is a front sectional view of the precarbonizing furnace.

FIGS. 2–4 of the drawings illustrate an example of one arrangement of precarbonizing furnace 19 and associated systems for treating the oxidized and stabilized fibers exiting the oxidizing oven 12 (FIG. 1). The tow of stabilized fibers leaving the oxidizing unit is guided around a roller 38 after the initial tensioning rollers 17 (FIG. 1 only) and enters the precarbonizing furnace 19 upwardly through a bottom gas seal assembly 40. The precarbonizing furnace may be vertically or horizontally disposed, relative to the path of the tow. A vertical path is employed in this example because it enables the tow to be passed directly across to an adjacent carbonizing furnace for downward passage therethrough to a final takeup reel. However, because of the fact that the heated gases seek to rise along the fibers, avoidance of redeposition of matter on the fibers is easier with a horizontal path and so in this sense the vertical furnace disclosed represents the solution to a more difficult problem. In the assembly 40 the fibers pass first between a pair of sparger rolls 41 which inject cold inert gas (nitrogen) and then between closely spaced water cooled tubes 42. The cold nitrogen maintains a positive internal pressure relative to ambient to insure against substantial ingress of air and oxygen about the tow of fibers as it enters. A low temperature level in the inlet region is assured by the presence of the water cooled tubes 42 in the assembly 40. The sheet of fibers then passes upwardly through a lower constricted extension or passage 43, through the central region 44 of the furnace 19, then through an upper constricted extension or passage 45 adjacent the upper end of the furnace, and exits between water cooled tubes 46 and then cold gas spargers 47 of a top seal assembly 48.

As the web of fibers enters the lower part of the central region 44 of the furnace 19, hot nitrogen, previously heated to a temperature, e.g. of about 400° C., is injected upwardly into the furnace through a pair of horizontally positioned parallel sparger bars 50. These spargers 50 are disposed closely adjacent each other laterally across the bottom portion of the furnace and on opposite sides of the distributed tow of fibers 52 passing through the furnace. Rows of orifices in the spargers 50 inject hot gas tangentially to the tow 52 and upwardly toward the furnace center along an internal metal muffle 54 which fits within the periphery of the furnace about the tow. As previously noted, the nitrogen is injected into the interior of the furnace 19 employing 10 to 17 liters of nitrogen per gram of carbon fiber.

The interior space or central heating region 44 of the furnace 19 is bounded by the muffle enclosure 54 (FIG. 3). Between the outer walls of the muffle 54 and the inner wall of the furnace 19 are positioned several vertically spaced conventional electrical heating elements 60 such as Nichrome band heaters, shown only in idealized form for simplicity. These heating elements 60 in conjunction with the hot nitrogen injected into the interior of the furnace 19 raise the temperature of the fiber tow 52 to about 600° C. in the mid-region of the furnace 19 as the tow 52 passes upwardly. The furnace 19 also has insulated outer walls 62 (FIG. 3) which can be formed of insulating material such as refractory bricks or tiles.

The hot nitrogen gases from the spargers 50 initially sweep upwardly as shown by the arrows 63 and 64 in FIGS. 2 and 3, and impinge tangentially on the tow 52 passing through the central interior of the muffle 54. Off-gassed products from the oxidized fibers that are entrained with the gas flows include carbon monoxide and can also include methane and nitrile substituted alkanes and alkenes, and tars. The large volume of hot nitrogen gases sweeps the off-gassed mixture and tars in turbulent flow upwardly in expanding fashion. While still at sufficiently high temperature to be in a mobile state and out of communication with the fibers, the products of decomposition exit laterally through spaced apart ports 65, 66, 67 on opposite sides of the muffle 54 and adjacent the edges of the tow 52. The exit ports 65, 66, 67 are coextensive with the length of furnace 19 that is heated by the elements 60, thus assuring that both the tow and gases are at high temperature in the region from which the hot gases are extracted. From the exit ports 65, 66, 67 the gases move into side manifolds 68, 70 and then into oppositely disposed insulated manifolds 71 at the bottom of the furnace 19. They are then combined to flow in a single insulated conduit 72. The off-gassed volatiles and tars are then conducted via conduit 72 to the afterburner 36 system of FIG. 1.

At the carbonizing furnace 24 entrained products of carbonization at temperatures in excess of approximately 400° C. are coupled via a conduit 75 to enter a reaction chamber in the preheater/afterburner 20. An air supply 76 and gaseous fuel source 77 are coupled into the reaction chamber to thoroughly burn the off-gassed products. At the upper end of the preheater/afterburner 20 cold nitrogen from a supply source 35 is passed into a heat exchanger 78 through which the products of combustion pass in thermal exchange relation. The thus heated input nitrogen, heated to the above noted temperature of about 400° C., is supplied via insulated conduits 80 from the afterburner heat exchanger 78 to the hot nitrogen spargers 50. Regulation or adjustment of the relative volume of cold nitrogen supplied subsequent to the heat exchanger 78 from a separate source 81 enables regulation of the temperature of the heated incoming gas into the furnace 19.

A baffle 82 (FIG. 3) is provided in the upper portion of the furnace above the muffle 54, to constrict and prevent a substantial part of the off-gassing in the central region of the furnace 19 from going upward to the top zone and eventually toward the upper seal assembly 48 so as to redeposit on the fiber tow 52. The separate insulated piping ducts 71 efficiently remove the off-gassed products from the side manifolds 68, 70 respectively by the use of two junctions, one adjacent each end of the associated side manifold 68, 70. Control of the relative rate of exhaustion of gases from these upper and lower junctions is effected by externally accessible dampers 84 (FIGS. 2 and 4) in the ducts 71 at locations just prior to where the flows from the junctions are united. The exhaustion of gases can thus be balanced between upper and lower ends of the furnace 19 so as to aid in maintaining a selected temperature profile. Constricted furnace extension volumes 43, 45 at each of the lower and upper ends, respectively, limit the capability of products of decomposition from reaching the bottom and top seal assemblies 40, 48 and condensing thereon. The upper extension 45 also aids in cooling down the fiber tow 52 sufficiently below it exits the furnace 19 so that it does not react with the oxygen in the air. The degree of cooling is such that off-gassing from the fiber material terminates before it reaches the top seal assembly 48, thus preventing tar condensation in such seal.

Valves 92 are provided in the opposite side ducts 71 so that the flow of exhaust gases can be balanced between the opposite sides of the furnace 19. This adjustment avoids the problem of having one side of the fiber tow 52 become significantly weaker than the other side due to a high concentration of gaseous tars on one side or the other of the fiber material. Flows of off-gases are approximately determined, and accordingly may be adjusted using the dampers 84 and valves 92, by the temperature differential of the gases in the ducts 71.

Figure 5:
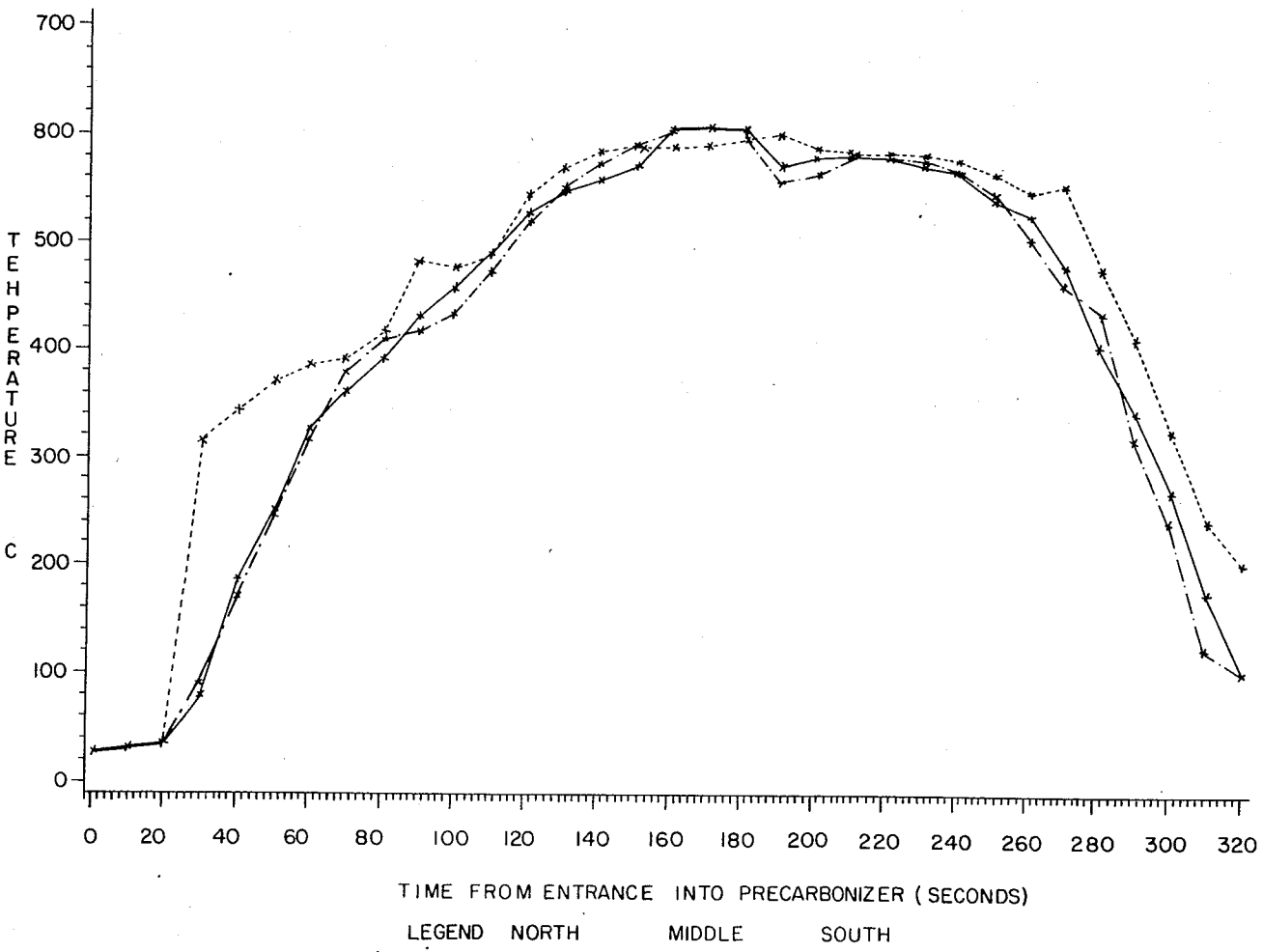
FIG. 5 is a temperature profile of temperature variations encountered by a stabilized polyacrylonitrile fiber passing through the precarbonizing furnace.

Thus, as may be seen graphically from the temperature profile of FIG. 5, in relation to the vertical furnace 19 of FIGS. 2–4, controlled temperature conditions confine the dynamic decomposition process essentially to the midregion of the furnace. The temperature of the previously oxidized fiber tow 52 is initially low at the entry region, where cold $N_2$ from the spargers 42 prevents ingress from the ambient air and where the adjacent water cooled tubes 41 and the extension section 45 provide thermal insolation from the furnace 19 interior. Once the tow section enters the furnace 19 a short distance, the temperature of the fibers themselves rises rapidly, at the outset principally because of the hot gases impinging on each side from the spargers 50. The gases, including products of decomposition, tend to upwell within the muffle 54, but are blocked from free vertical movement because of the high flow impedance presented by the baffle 82 at the upper end, and the adjacent narrow extension 45. Instead, the flows encounter much less resistance to lateral movement and thus quickly begin to move to the lowermost side exit ports 67. Actual fiber temperature plotted in FIG. 5 is thus seen to gradually increase from about ambient temperature up to about 600° C. in the middle zone of the furnace. In this region the supplemental heaters 60 are most effective. The greatest activity in emission of volatiles and tars from the heated carbon fibers occurs in the range of up to about 500° C., which can be seen in FIG. 5 to occur in about the lower third of the furnace. The products of decomposition in this region are additionally swept away toward the middle and upper side exit ports 66, 65 respectively by the nitrogen purge gas. After the peak of about 600°–620° C. the temperature of the tow 52 quite rapidly decreases as it approaches the top of the furnace 19 to a level which is close to ambient. This cooling within the furnace occurs because of the efficient withdrawal of hot gases, and the cool structure coupled to the upper end of the furnace 19, and may be aided by using lower wattage to drive the upper heater 60 in comparison to the lower ones. When the fiber tow exits the precarbonizing furnace 19 into the upper extension 45 and then into the upper seal assembly 48 the temperature is well below the decomposition temperature. Furthermore, because the hot gases were drawn off previously, this cold exit region is effectively isolated from the hot volatiles and tars. Because such gaseous and decomposed flow components are drawn off quickly and allowed to cool very little, the tendency to collect or redeposit on the fibers is minimized. Consequently the partially carbonized tow 52 leaving the furnace 19 is essentially free of tar deposition and imperfections and is substantially uniform throughout.

The usage of substantial amounts of hot inert gas in this manner provides a number of material advantages. In being heated above 400° C. the inert gas has a substantially higher effective volume than it would otherwise have when injected. Moreover, the impinging gases both facilitate the needed initial temperature rise and create movement away from the fibers in the products of decomposition with which they combine. Of perhaps equal importance, the hot nitrogen prevents the condensation of tar inside the furnace, thus avoiding dripping of these tars back onto the tow or onto the cooler end seal assemblies, particularly in the lower part of the furnace. Separate precarbonization combined with stretch in a specified range thus preconditions the fibers in a most advantageous manner for subsequent completion of carbonization.

The precarbonized stabilized multi-filament tow 52 is then conducted as best seen in FIGS. 1 and 2 over the second tensioning stand 26 before entering the carbonizing furnace 24 downwardly from the top. As the precarbonized tow 52 passes downwardly through the carbonizing furnace 24, it encounters first an initial zone which raises the temperature of the fibers to between about 850° and 900° C. The second or middle zone 88 raises the temperature of the fibers up to about 1100° C., and thereafter the tow passes through the lowermost third zone 90, which raises the temperature of the fibers to a maximum of between about 1200° and 1250° C. As noted above the final temperature level is determined in accordance with the tensile and modulus properties desired in the fibers. The carbonizing furnace 24 is of conventional type, the successive zones being heated by suitable conventional electrical elements such as graphite susceptors, although inductive or resistive elements may alternatively be used.

During passage through the carbonizing furnace 24, the fibers are restrained from shrinkage beyond a predetermined amount by a velocity differential between the second tensioning stand 26 and the third tensioning stand 30. Shrinkage of the heated and stabilized fibers is limited to the range of −2.5% to −5.0% (negative stretch), in comparison to the length of the precarbonized or stabilized fibers exiting the precarbonizing furnace 19.

The residence time of the tow of fibers 52 in the carbonizing furnace 24 can range from about 4 to about 10 minutes. The carbonized fibers exiting the carbonizing furnace 24 are passed from the last tensioning stand 30 onto the takeup reel 33.

The carbon fibers treated according to the invention process, especially as a result of the precarbonizing treatment under the conditions noted and described above, are free of any tar deposits, and are of high tensile strength, low thermal conductivity, have very high electrical resistance and are hydrophobic. Affirmative and substantial stretch in the precarbonization zone, together with restraint from shrinkage in the carbonization zone derive greatest benefit in physical properties when there is hot gas heating in the initial, most critical decomposition zone. Because tars are not dispersed or deposited on the fibers in the precarbonization zone, an increase in line speed of the fibers is enabled through all of the treating zones including the oxidation, precarbonization and carbonization zones. Other advantages of the invention process include making longer continuous runs with substantially reduced shutdown and producing improved carbon fibers with improved physical properties, for example fibers having in excess of 600,000 psi tensile strength and greater than 1.5% strain to failure (expressed as ratio of tensile to modulus). The process also enables production of improved lower modulus carbon fibers having less than 30 msi modules with lower thermal and electrical conductivity for special aerospace applications, while also allowing production at lower final temperatures then heretofore of higher modulus, greater than 35 msi, fibers.

The following are examples of practice of the invention:

EXAMPLE I

Using 500 ends of 6K (6,000 filaments) tow having 600 ends, of Mitsubishi polyacrylonitrile, the tow was passed through an oxidizer having four temperature stages of 235°, 245°, 246° and 247° C., respectively, while the fibers were elongated or stretched about 12% relative to the original length of the fibers. The tow was passed through the oxidizing oven at a speed of about 3.1 feet per minute and the fibers were oxidized to an oxidation density of about 1.37. The residence time in the oxidizing oven was about 80 minutes.

The resulting oxidized fiber tow was then passed through a precarbonization furnace while the fibers were being heated to a temperature in a range of about 400° to about 600° C. while impinging hot nitrogen gases heating the fibers to a temperature of 400° C. The flow of nitrogen was at a rate or dilution factor of 13 liters of nitrogen per gram of carbon fiber. The desired flow of nitrogen into the precarbonizer corresponded to 550 scfh for each bottom sparger in the precarbonizing furnace. During passage through the precarbonizing furnace, the tow was stretched about 7.5% relative to the original length of the precursor fibers. Residence time of the tow in the precarbonizer was about seven minutes.

The previously heated and precarbonized tow was then carbonized in a carbonizing furnace by passage through three zones therein at a temperature of about 800° to 900° C. in the first zone, up to about 1100° C. in the second zone and up to about 1200° to 1250° C. in the third zone, while maintaining a shrinkage (negative stretch) of the tow of about −4.5%.

The resulting tow of carbon fibers had a high tensile strength of about 573,000 psi and modulus of about 35,000,000 psi.

EXAMPLE II

Using a 3K polyacrylonitrile tow with 600 ends, such precursor fibers were subjected to oxidizing, precarbonizing and carbonization essentially under the conditions of Example I, the precarbonization being carried out in a precarbonizer furnace having a length of 200 inches.

Over the 200 inches of the furnace, as seen in FIG. 5, the temperature is relatively at ambient for more than the first 10 inches then rises substantially linearly up to about 60 inches, when it is approximately 420° to 480° C., then forms a rounded top with values of approximately 580° C. at 80 inches, a peak of approximately 600° C., at 100 inches, lowering down to a value of approximately 550° C. at 140 inches and then a substantially linear drop in temperature to approximately 190 inches where the temperature is approximately 100° C. and then levels off slightly to a few degrees less at the outlet.

The exhaust from the precarbonization furnace was measured at 97.1% $N_2$ and 2.9% total off-gassing. Gas analysis showed that 0.122% of this was gases, the great majority of which were carbon monoxide, with virtually trace amounts of acrylonitrile, cyanide and hydrocyanic acid gases. Thus, the conclusion was that tars and other constituents constituted 2.78% of the off-gassed products.

EXAMPLE III

The procedure of Example I was carried out except that the amount of hot nitrogen purge gas was reduced below 10 liters per gram of carbon fiber, down to a rate of 7.2 liters per gram of carbon. The resulting carbon fibers contained local tar deposits and the tensile strength of the resulting fibers was substantially reduced to about 431,000 psi.

EXAMPLE IV

Using Sumitomo 12K polyacrylonitrile tow, the tow was subjected to (a) oxidizing and carbonizing, employing procedure similar to Example I, but without any precarbonizing, (b) oxidizing, precarbonizing and carbonizing as in Example I, but without the use of hot nitrogen purge gas during precarbonizing, and (c) the procedure of Example I employing precarbonizing with hot nitrogen in the precarbonizer as in Example I.

Running a total of 0.9 meg filaments without precarbonizing, according to procedure (a) above, the run had to be stopped every 12 to 24 hours to clean the tars and soot at the furnace seals and the exhaust system.

Running a total of 3.0 meg filaments with precarbonization with hot nitrogen according to procedure (c) above, the maximum days of running time was not determined because the precursor fibers were used up before clean up was necessary. This increased productivity and also reduced waste significantly.

The ultimate tensile strength of the fibers produced by procedures (a), (b) and (c) was as follows:

TABLE I

| | (UTS - per) |
|---|---|
| (a) without precarbonizing | 482,000 |
| (b) precarbonizing without hot $N_2$ | 532,000 |
| (c) precarbonizing with hot $N_2$ | 575,000 |

It is seen from the table above that the ultimate tensile strength of the carbon fibers produced according to procedure (c) of the invention was substantially higher than in the case of procedures (a) and (b), not utilizing the precarbonizing features and conditions of the invention process.

EXAMPLE V

3K Mitsubishi polyacrylonitrile tow was processed to produce carbon fibers, by oxidizing, precarbonizing and carbonizing, the oxidizing and carbonizing taking place at substantially under the same conditions as in Example I above, and wherein the oxidized tow was precarbonized in a precarbonizing furnace of the type illustrated in FIGS. 2–4 of the drawing, under the processing conditions shown in Table II below.

TABLE II

| Process Parameters | |
|---|---|
| Precursor | Mitsubishi |
| Filament Count | 3K |
| Number of Ends | 599 |
| Total Number of Filaments | 1,800,000 |
| Precarbonizer | |
| Temperatures: | |
| Zone I | 400° C. |
| Zone II | 640° C. |
| Zone III | 600° C. |
| East Bot. Sparger $N_2$ Temperature | 430° C. |
| West Bot. Sparger $N_2$ Temperature | 419° C. |
| East Bot. Sparger $N_2$ Flow Rate | 550 SCFH |
| West Bot. Sparger $N_2$ Flow Rate | 550 SCFH |
| Top Seal $N_2$ Flow Rate | 1100 SCFH |
| East Bot. Seal $N_2$ Flow Rate | 700 SCFH |
| West Bot. Seal $N_2$ Flow Rate | 700 SCFH |
| Total $N_2$ Flow Rate to Furnace | 4150 SCFH |
| Exit Seal Pressure | 0.095 In. $H_2O$ |
| Entrance Muffle Pressure | 0.1 In. $H_2O$ |
| Entrance Seal Pressure | 0.01 In. $H_2O$ |
| Exit Muffle Pressure | 0.0 In. $H_2O$ |
| Dilution Factor | 15.17 |

The expression "SCFH" in the table above means standard cubic feet per hour, and the dilution factor in the table above is the number of liters of hot nitrogen per gram of carbon fibers.

From the foregoing, it is seen that the invention provides novel procedures for producing carbon fibers from precursor fibers such as polyacrylonitrile, having improved properties, including high tensile strength and freedom from local tar deposits, by employing an oxidizer, precarbonizer and carbonizer, in which the precarbonizing of the oxidized and stabilized fibers is carried out under certain temperature conditions, particularly employing a hot nitrogen purge at a temperature of about 400° C. and employing about 10–17 liters of nitrogen per gram of carbon fibers, while stretching the fibers from about 5% to about 20%. The precarbonizing treatment particularly functions to remove a major portion of volatile products from the fibers in the precarbonizer, to reduce the oxygen content of the fibers at lower temperatures and improve subsequent carbonization, permit stretching of the fibers at more effective lower temperatures to improve physical properties, and by utilization of a hot nitrogen purge gas under the conditions noted above, increasing the rate of production and efficiency, while reducing tar deposition on the fibers to improve tensile strength thereof.

Figure 6:
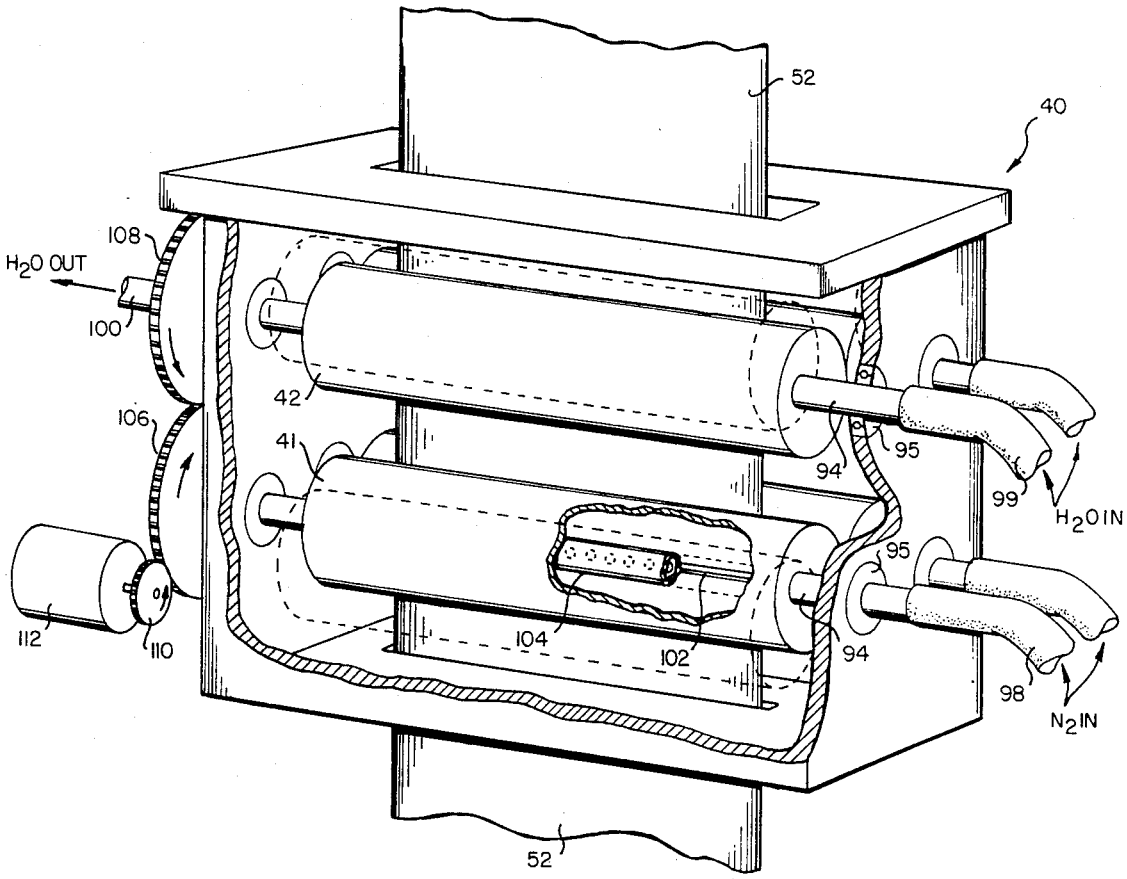
FIG. 6 is a perspective view, partially broken away. of an end seal arrangement that may be employed in the furnace system of FIGS. 2–4.

An advantageous arrangement for the bottom gas seal assembly 40 is shown in FIG. 6, in which reference is now made. The top seal assembly is essentially the same, but with the tubes and spargers reversed in position. Both the pair of gas injection spargers 41 and the pair of water cooled tubes 42 are mounted eccentrically on hollow shafts 94 which rotate within roller bearings 95 mounted in the housing structure 96 for the assembly 40. A flexible gas supply line 98 is coupled to the input side of the sparger 41, while flexible input and output water lines 99, 100 are coupled to the different ends of the water cooled tubes 42. The flexible lines 99, 100 permit an adequate angle of rotation (e.g. 90°) of the associated spargers and tubes to separate the elements of a pair of entry of the fiber tow 52. The spargers 41 each include a longitudinal slit 102 along one side, positioned to be adjacent the tow 52 when the spargers 41 are rotated to closest proximity to each other. An internal plenum 104 within the sparger provides uniform distribution of gas along the length of the slit. At one end of the assembly 40 intercoupled gears 106, 108 mounted on the hollow shafts 94 are rotated between open and closed positions for the spargers 41 and tubes 42 by a drive gear 110 turned by a motor 112. Limit switches (not shown) in the assembly 40 may be in circuit with the motor 112 so as to determine precise open and closed positions for the mechanism and avoid the possibility of an overtravel in either direction. In the position shown in FIG. 6 the spargers 41 and tubes 42 are in operative relation to the tow 52, with sufficient room between the opposed pairs only to pass the tow 52. When the shafts 94 are rotated 90° so as to separate each element of a pair there is adequate space to thread the tow 52 through and also to service the interior of the assembly 40. Similar gears (not visible in FIG. 6) are used to rotate the sparger 41 and tube 42 of each pair toward of away from the fiber tow 52.

This arrangement insures positive pressure inside the furnace 19 and muffle 54 relative to ambient air, and thus avoids the introduction of oxygen that might induce combustion or after the off-gassing process. Both the cold nitrogen and the cooling water provide a substantial thermal barrier to the internal furnace temperature level, and therefore aid in maintaining the desirable temperature gradient of FIG. 5.

Since various changes and modifications of the invention will occur to and can be made readily by those skilled in the art without departing from the invention concept, the invention is not to be taken as limited except by the scope of the appended claims.

What is claimed is:

1. The method of producing carbon fibers having high tensile strength from carbon-containing precursor fibers comprising the steps of:

(a) heating the fibers under oxidizing conditions at a temperature ranging from about 220° to about 300° C. while elongating the fibers in a range of 10%–15% relative to their original length to provide stabilized fibers;

(b) heating the stabilized fibers in the range of about 350° to about 620° C. while passing heated inert gas at a temperature of at least about 400° C. across the fibers in an amount of between about 10 and 17 liters of gas per gram of fibers, while concurrently stretching the fibers from about 5% to about 20% in comparison to the length of the stabilized fibers, thereby precarbonizing said fibers; and (c) thereafter carbonizing the previously heated stabilized and precarbonized fibers at a temperature in the range of about 800° to about 1250° C., while limiting shrinkage (negative stretch) to the range of about −2.5% to −5.0%.

2. The method of claim 1, wherein step (a) is carried out by exposure of the precursor fibers to an oxygen-containing gas at a temperature ranging from about 240° to about 280° C., and for a total interval of about 60 to about 90 minutes.

3. The method of claim 1, wherein the fibers are maintained in an inert atmosphere during the precarbonizing step (b) and the fibers are cooled to below about 200° C. in the inert atmosphere before termination of the precarbonization step.

4. The method of claim 3, wherein the precarbonizing step (b) is carried out in an elongated region and the heated inert gas and out-gassed products from the fibers are extracted in an intermediate portion of the elongated region such that the temperature decreases monotonically from a peak to a final temperature below the level at which oxidation reaction occurs.

5. The method of claim 1, said fibers being heated in step (b) in a range of about 400° to about 600° C. to precarbonize said fibers, said inert gas in step (b) being preheated to a temperature in the range of about 400° to 420° C., and impinging said heated inert gas on said fibers in an amount of about 13 liters of nitrogen per gram of fibers, and removing in excess of about 90% of tars from the fibers during the precarbonizing step (b).

6. The method of claim 5, wherein the residence time of said fibers in said precarbonizing step (b) ranges from about 5 to about 10 minutes.

7. The method of claim 1, said carbonizing of said stabilized fibers in step (c) being carried out in three zones, the first zone at a temperature ranging from about 850° to about 900° C., in the second zone at a temperature of about 1100° C., and the third zone at a temperature from about 1200° to 1250° C.

8. The method of claim 5, said fibers being heated in step (b) in a range of about 400° to about 600° C. to precarbonize said fibers, and said inert gas in step (b) being nitrogen heated to a temperature in the range of about 400° to 410° C., and impinging said heated nitrogen on said fibers in an amount of about 13 liters of nitrogen per gram of fibers, and removing in excess of about 90% of tars from the fibers during the precarbonizing step (b), the residence time of said fibers in said precarbonizing step (b) ranging from about 5 to about 10 minutes.

9. The method of partially carbonizing fibers for subsequent complete carbonization comprising the steps of:

passing the fibers vertically upward continually through an enclosed environment;

heating the fibers initially within at least one upwardly directed stream of inert gas heated in excess of 400° C.;

heating the fibers uniformly within a central region of the enclosed environment to a temperature of as much as about 620° C.;

removing the hot gases and off-gassed products from the central region of the enclosed environment;

cooling the fibers in the enclosed environment to below reactive temperature before removal; and stretching the fibers passing through the enclosed environment in the range of 5% to 20%.

10. The method as set forth in claim 9 above, wherein the fibers are in the form of a distributed planar sheet and wherein the hot gas is directed upwardly along each side of the sheet and removed along the side edges of the sheet.

11. The method as set forth in claim 10 above, wherein the temperature of the fibers in the enclosed environment gradually rises to a maximum at the central region of the enclosure from portions of the enclosure on opposite sides of the central region.

12. In a method of processing carbon-containing precursor fibers to provide carbon fibers, the steps of oxidizing said precursor fibers in an oxidizing atmosphere at elevated temperature while elongating the fibers, precarbonizing said oxidized fibers by further heating said oxidized fibers to remove volatiles and tars, while concurrently stretching the fibers, and carbonizing said precarbonized fibers by further heating at temperatures in excess of about 800° C., while limiting shrinkage of said fibers, the improvement which comprises:

precarbonizing said oxidized fibers in a heating zone at a temperature in the range of about 350° to about 620° C. in an inert atmsophere, impinging heated inert gas at a temperature in excess of about 400° C. on the fibers prior to the heating zone;

removing in excess of about 90% of tars from the fibers while preventing redeposition of the tars on the fibers in the heating zone; and concurrently stretching the fibers from about 5% to about 20% in comparison to the length of the oxidized fibers.

13. The improvement of claim 12, said precarbonizing being carried out by heating said oxidized fibers at a temperature in the range of about 400° to about 600° C., said inert gas being nitrogen heated from about 400° to about 420° C. and impinging said inert gas on the fibers in an amount of about 10 to 17 liters per gram of fibers.

14. The improvement of claim 12, the residence time of said oxidized fibers during precarbonizing ranging from about 5 to about 10 minutes and the fibers being stretched between about 5% and 10% of their prior length.

15. The improvement of claim 12, said precursor fibers being polyacrylonitrile fibers, said precarbonizing being carried out by heating said oxidized fibers at a temperature in the range of about 400° to 600° C., said inert gas being nitrogen, and impinging said nitrogen on the fibers in an amount of about 13 liters per gram of fibers, the residence time of said fibers during said precarbonizing ranging from about 5 to about 10 minutes.

16. A method of carbonizing fibers which have previously been oxidized, comprising the steps of:

initially heating the fibers with an impinging volume of inert gas heated to temperatures in excess of at least about 220° C., the fibers being maintained inaccessible to oxygen;

thereafter locally heating the fibers to a peak of approximately 600° C. while maintaining inaccessibility to oxygen, and concurrently stretching the fibers 5–20% relative to their length prior to heating;

diverting off-gassed products out of communication with the fibers in the locally heated region while maintaining the off-gassed products above a recondensation temperature while in the proximity of the fibers;

cooling the fibers while out of communication with oxygen; and subsequently heating the thus treated fibers to a final carbonizing temperature in an inert atmosphere while tensioning the fibers to maintain shrinkage in the range of −2.5% to −5% relative to their immediately prior length.

17. The method as set forth in claim 16 above, wherein the fibers are moved continuously through an inert atmosphere zone while being stretched 5–10%.

18. The method as set forth in claim 17 above, wherein the inert gas is heated to approximately 400° C. and impinges on the fibers before the peak temperature region of the inert atmosphere zone.

19. The method as set forth in claim 18 above, further including the step of supplying auxiliary heat to the fibers in the local heating zone to establish a peak temperature of approximately 600° C. in an intermediate region of the inert atmosphere zone.

20. The method as set forth in claim 19 above, further including the steps of burning off-gassed products derived from heating the fibers to final carbonization temperature, and preheating the inert gas therewith.

21. The method as set forth in claim 20 above, further including the step of maintaining the heated inert gas in a selected temperature range by mixing a controlled amount of unheated inert gas therewith.

22. The method of claim 1, wherein the limiting of shrinkage to the range of about −2.5% to −5.0% in step (c) is done independently of and using a substantially different amount of tension in the fibers than the concurrent stretching of the fibers from about 5% to about 20% in step (b).

23. The method of claim 1, wherein the heated inert gas in step (b) is provided by a first source of inert gas, and comprising the further step of passing heated inert gas from a second source independent of the first source across the fibers during step (c).

24. The method of producing carbon fibers having high tensile strength from carbon-containing precursor fibers comprising the steps of:

(a) heating the fibers under oxidizing conditions at a temperature ranging from about 220° to about 300° C. while elongating the fibers in a range of 10%–15% relative to their original length to provide stabilized fibers;

(b) heating the stabilized fibers in the range of about 350° to about 620° C. while passing heated inert gas at a temperature greater than the highest temperature used in the step of heating the fibers under oxidizing conditions across the fibers in an amount of between about 10 and 17 liters of gas per gram of fibers, while concurrently stretching the fibers from about 5% to about 20% in comparison to the length of the stabilized fibers, thereby precarbonizing said fibers; and (c) thereafter carbonizing the previously heated stabilized and precarbonized fibers at a temperature in the range of about 800° to about 1250° C., while limiting shrinkage to the range of about −2.5% to 5.0%.

25. The method of claim 24 wherein the precarbonizing step (b) is carried out in an elongated region and the heated inert gas and out-gassed products from the fibers are extracted in an intermediate portion of the elongated region such that the temperature decreases monotonically from a peak to a final temperature below the level at which oxidation reaction occurs.

26. The method of partially carbonizing fibers for subsequent complete carbonization comprising the steps of:

passing the fibers vertically upward continually through an enclosed environment;

heating the fibers initially within at least one upwardly directed stream of inert gas heated to a temperature sufficient to produce an onset of decomposition of the fibers;

heating the fibers uniformly within a central region of the enclosed environment to a temperature in the range of about 350° to about 620° C.;

removing the hot gases and off-gassed products from the central region of the enclosed environment;

cooling the fibers in the enclosed environment to below reactive temperature before removal; and stretching the fibers passing through the enclosed environment in the range of 5% to 20%.

27. In a method of processing carbon-containing precursor fibers to provide carbon fibers, the steps of oxidizing said precursor fibers in an oxidizing atmosphere at elevated temperature while elongating the fibers, precarbonizing said oxidized fibers by further heating said oxidized fibers to remove volatiles and tars, while concurrently stretching the fibers, and carbonizing said precarbonized fibers by further heating at temperatures in excess of about 800° C., while limiting shrinkage of said fibers, the improvement which comprises:

precarbonizing said oxidized fibers in a heating zone at a temperature in the range of about 350° to about 620° C. in an inert atmosphere, impinging heated inert gas at a temperature sufficient to cause substantial off-gassing of volatile gases on the fibers prior to the heating zone;

removing in excess of about 90% of tars from the fibers while preventing redeposition of the tars on the fibers in the heating zone; and concurrently stretching the fibers from about 5% to about 20% in comparison to the length of the oxidized fibers.

* * * * *